US012648606B2

(12) United States Patent
Bjornsdottir et al.

(10) Patent No.: US 12,648,606 B2
(45) Date of Patent: Jun. 9, 2026

(54) AIRBAG-HELMET AND AIRBAG ADAPTED FOR BEING USED AS A PART OF SUCH AN AIRBAG-HELMET

(71) Applicants: AUTOLIV DEVELOPMENT AB, Vargarda (SE); POC SWEDEN AB, Stockholm (SE)

(72) Inventors: Johanna Bjornsdottir, Nossebro (SE); Bengt Pipkorn, Sävedalen (SE); Hassan Jan, Alingsås (SE); Jack Johansson, Landvetter (SE); Dobrila Lucic, Gothenburg (SE); Johan Weman, Saltsjö Boo (SE); Fredrik Hallander, Älvsjö (SE); Oscar Huss, Saltsjöbaden (SE)

(73) Assignees: Autoliv Development AB, Vargarda (SE); POC Sweden AB, Stockholm (SE)

( * ) Notice: Subject to any disclaimer, the term of this patent is extended or adjusted under 35 U.S.C. 154(b) by 69 days.

(21) Appl. No.: 18/555,917

(22) PCT Filed: Apr. 20, 2022

(86) PCT No.: PCT/EP2022/060401
§ 371 (c)(1),
(2) Date: Oct. 18, 2023

(87) PCT Pub. No.: WO2022/223604
PCT Pub. Date: Oct. 27, 2022

(65) Prior Publication Data

US 2024/0197022 A1 Jun. 20, 2024

(30) Foreign Application Priority Data

Apr. 22, 2021 (DE) ..... 10 2021 110 249.9

(51) Int. Cl.
*A42B 3/04* (2006.01)

(52) U.S. Cl.
CPC ..... *A42B 3/0486* (2013.01); *A42B 3/046* (2013.01)

(58) Field of Classification Search
USPC ..... 2/210, 411, 413
See application file for complete search history.

(56) References Cited

U.S. PATENT DOCUMENTS 4,685,151 A * 8/1987 Kincheloe ..... B62J 27/20 2/466
10,390,580 B2 8/2019 Olsson et al.
(Continued)

FOREIGN PATENT DOCUMENTS

DE 1944821 A1 3/1971
DE 102011116453 A1 4/2013
(Continued)

OTHER PUBLICATIONS

Machine translation of DE102011116453A1 obtained via Espacenet.com on Mar. 21, 2025. (Year: 2011).*
(Continued)

*Primary Examiner* — Matthew R Marchewka
(74) *Attorney, Agent, or Firm* — Dickinson Wright PLLC

(57) ABSTRACT

An airbag-helmet having a protective main body (10) having an inner surface pointing towards the head of the user when the helmet is worn, and an outer surface pointing away from the head of the user when the helmet is worn. Further, an inflator (40) and an airbag (30) being attached to the protective main body (10) at least indirectly and being in fluid communication to the inflator (40) are provided. The airbag (30) includes at least one tubular protection section (30*a*, 30*b*, 30*c*) extending from the outer surface of the protective main body (10) when the airbag (30) is filled with gas by the inflator (40).

16 Claims, 5 Drawing Sheets

(56) References Cited

U.S. PATENT DOCUMENTS

Figure 1:
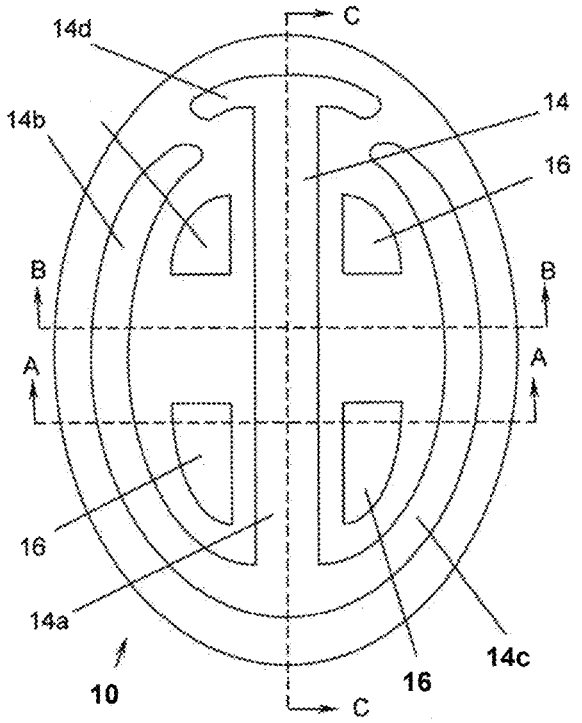

| | | | | |
|---|---|---|---|---|
| 2012/0102630 | A1* | 5/2012 | Anderson | A42B 3/0486 2/413 |
| 2013/0276213 | A1* | 10/2013 | Olsson | A42B 3/122 2/468 |
| 2016/0120238 | A1* | 5/2016 | Duncan | A63B 71/1291 2/462 |
| 2016/0366968 | A1* | 12/2016 | Kass | A42B 3/283 |
| 2017/0325533 | A1* | 11/2017 | Allen | A42B 3/12 |
| 2019/0125025 | A1* | 5/2019 | Williams | A42B 3/066 |
| 2022/0015490 | A1* | 1/2022 | Drasler | A42B 1/203 |
| 2023/0074709 | A1* | 3/2023 | Descrovi | A42B 3/0486 |

FOREIGN PATENT DOCUMENTS

| | | | |
|---|---|---|---|
| EP | 2621297 | B1 | 8/2017 |
| EP | 3326476 | A1 | 5/2018 |
| KR | 102099190 | B1 | 4/2020 |
| WO | 2010064057 | A1 | 6/2010 |

OTHER PUBLICATIONS

International Search Report and Written Opinion of PCT/EP2022/060401, mailed Jul. 27, 2022.

* cited by examiner

AIRBAG-HELMET AND AIRBAG ADAPTED FOR BEING USED AS A PART OF SUCH AN AIRBAG-HELMET

CROSS-REFERENCE TO RELATED APPLICATIONS

This application is a 35 U.S.C. § 371 national phase of PCT International Application No. PCT/EP2022/060401, filed Apr. 20, 2022, which claims the benefit of priority under 35 U.S.C. § 119 to German Patent Application No. 10 2021 110 249.9, filed Apr. 22, 2021, contents of which are incorporated herein by reference in its entirety.

TECHNICAL FIELD OF THE INVENTION

The invention relates to an airbag-helmet, especially to a lightweight airbag-helmet and to an airbag adapted for being used as a part of such an airbag helmet as described in the following written description and as illustrated by the appended drawing figures.

BACKGROUND

Bicycle helmets are known in the prior art. Bicycle-helmets are lightweight and comprise a protective main body which is most often manufactured from a foamed plastic material. Despite the low weight, such helmets give a high degree of protection in case of a bicycle accident. Therefore, the use of such helmets has become more and more popular and in many countries almost every bicycle rider wears such a helmet.

A traditional helmet of this type comprises a protective main body having an inner surface facing towards the head of the user and an outer surface facing away from the head of the user when the helmet is worn. This protective main body is usually made of a lightweight and shock absorbing material, for example of a foamed plastic material like expanded polystyrene (EPS). Two straps extend from this protective main body which can be connected to one another by a releasable connection, such that the protective main body and thus the helmet can safely be secured to the head of the user (often a bicycle rider). Often, a thin cover (also referred to as "rigid shell") is attached to the outer surface of the protective main body.

In order to provide some sort of ventilation to the user's head, most helmets comprise through openings extending from the outer surface to the inner surface of the helmet.

Prior Art Example

From EP 2 621 297 B1 a head protection device for bicycle riders is known which does not use a helmet which is worn on the head. Instead, an airbag is provided which is in a resting state is worn around the neck of the bicycle rider. This head protection further comprises an inflator and an actuation mechanism. This actuation mechanism usually comprises an inertia sensor detecting an unusual acceleration of the head which is typical in an accident. When the airbag is inflated, it covers substantial parts of the head of the user such that the head is protected when hitting a hard surface after an unusual movement has been detected.

The main advantage of the head protection device described in EP 2 621 297 B1 is that it is usually more comfortable to wear than a helmet, especially in the summer. But this head protection device also has severe drawbacks, the most relevant of those are: The device does not give any protection in the case that the bicycle rider's head hits an obstacle without a preceding acceleration or deceleration. This can especially occur when the head of the bicycle rider hits a low hanging branch of a tree or a similar obstacle. The other essential drawback is that in case of a malfunction of the actuation mechanism, the head is not protected at all.

Problem to be Solved

Starting from this prior art it is an object of the invention to provide an improved helmet.

SUMMARY OF EMBODIMENTS OF THE INVENTION

According to the invention, the helmet comprises a protective main body which can basically be shaped like a protective main body of a traditional bicycle helmet meaning that it also has the protection function as the protective main body of a traditional bicycle helmet. Additionally, the helmet comprises an airbag device being attached to the protective main body, such that the helmet is an airbag-helmet. The airbag device comprises an inflator and an airbag. This airbag has at least one tubular protection section that extends from the outer surface of the protective main body when the airbag is filled with gas by the inflator.

Usually, more than one tubular protection section is necessary and especially three tubular protection sections can be provided. Preferably, all tubular protection sections are in fluid connection and filled by a common inflator, such that only one inflator is needed.

It is further preferred that all protection sections are parts of a single airbag such that no connecting pipes between the protection sections or the like are needed.

Like a typical airbag, the airbag of the inventive airbag-helmet consists of or comprises a flexible airbag material. Like traditional airbags known from automobiles, it is preferred that this flexible airbag material is substantially inelastic. The flexible, inelastic airbag material can be a "traditional" airbag material, especially a woven plastic material. In case that the airbag is made in the one-piece-woven technique, the airbag can exclusively consist of this woven plastic material. In other embodiments, the airbag can comprise two layers that are connected to each other by at least one connection, for example a seam. These two layers can also consist of a traditional airbag material, especially a woven plastic material. As an alternative, a foil material can be used. In the latter case, the at least one connection could also be a welding seam or a bonded joint. In all cases, the airbag as a whole is flexible but inelastic. In order to enhance the robustness, it can be preferred to cover at least a section of the airbag material with a coating.

In the case that the airbag comprises two distinct layers, each layer can be made from a distinct cutting, or the two layers can be folded from a joint cutting.

Since the one-piece-woven technique is relatively complicated and in order to provide a robust, but easy to manufacture airbag, it will often be preferred that the airbag is assembled (sewn, welded, or bonded) from two layers of a flexible, inelastic airbag material.

It is further preferred that the tubular protection sections extend essentially in the longitudinal direction of the airbag-helmet, meaning from a rear end area of the protective main body to a front end area of the protective main body. In a preferred case of three tubular protection sections, there is a left tubular protection section, a right tubular protection section and a middle tubular protection section and preferably a symmetry plane extends along the middle tubular protection section.

Due to the tubular shape of the protection sections a large gain in safety can be achieved with a minimum of volume to be filled with gas.

The airbag device of the airbag-helmet usually additionally comprises an actuation mechanism for triggering the inflator and/or for opening a passage between the inflator and the airbag. This actuation mechanism may compromise an acceleration sensor. In this connection, a deceleration is also to be understood as acceleration namely a negative acceleration.

In case of an accident that leads to a typical "accident acceleration" the airbag deploys because it is filled with gas from the inflator and thus extends from the outer surface of the protective main body and thus enhances the thickness of the helmet at least in sections. This means that an additional "protection depth" is provided for the head. This additional "protection depth" leads to an improved protection. Because the head is not protected by the airbag alone, the deployed airbag can be relatively soft such that excessive decelerations can be avoided when the airbag-helmet (meaning the airbag) hits an obstacle like a part of a car or a street surface.

It is preferred that the deployed protection sections extend at least 5 mm, preferably at least 10 mm from the outer surface of the protective main body.

Another advantage is that in cases in which the airbag does not deploy, for example if no initial acceleration/deceleration takes place, the head of the user is still protected by the protective main body as in the case of a traditional helmet.

Further, the protective main body protects the user's head in case of a second impact even if the airbag is not in a deployed state anymore.

The protective main body preferably consists of a foamed material, such as a foamed plastic material, like the main body of a traditional bicycle helmet.

Also, the geometry of the protective main body preferably corresponds essentially to the geometry of the protective main body of a traditional bicycle helmet, so that it has preferably a minimum thickness of at least five millimeters.

In order to provide ventilation to the user's head, the protective main body can comprise at least one through opening.

Also like in the case of traditional bicycle helmets, a cover can be attached to the outer surface of the protective main body. In this case, this cover does not only have decorative purposes, it can also cover and thus protect the un-deployed airbag which can be located between the protective main body and the cover. In this configuration, the airbag is usually not seen at all as long as it is in its un-deployed state. This cover (also referred to as "rigid outer shell") can be made from a traditional bicycle helmet shell material, like polypropylene, polycarbonate or acrylonitrile butadiene styrene (ABS).

In order to make sure that the airbag can deploy properly, it can be preferred to provide at least one breaking line in the cover. This breaking line can for example be a weakening line, a perforation or multiple perforations.

In order to generate an accommodation for the un-deployed airbag, a groove can be provided in the protective main body and/or in the cover. In one embodiment, such a groove can be "deep and narrow" such that it has a width of several millimeters and a depth of about 1 cm. In another embodiment, such a groove is "wide and shallow" such that it has a width equal to the width of the un-folded and un-deployed tubular protection section of the airbag and a depth of between 2 to 5 millimeters.

Preferably the deployed airbag covers between 20% and 50% of the outer surface of the protective main body.

Although the inventive airbag-helmet might have a little more mass than a traditional bicycle helmet, it is still lightweight such that it can be used as a bicycle helmet with increased protection properties. Additionally, these increased protection properties lead to additional application possibilities. For example the inventive helmet could also be used by any kind of motorized vehicles without a body, like two wheelers, trikes, quads and the like.

The invention will now be described by means of preferred embodiments in view of figures. The figures show:

BRIEF DESCRIPTION OF THE DRAWING FIGURES

Figure 2:
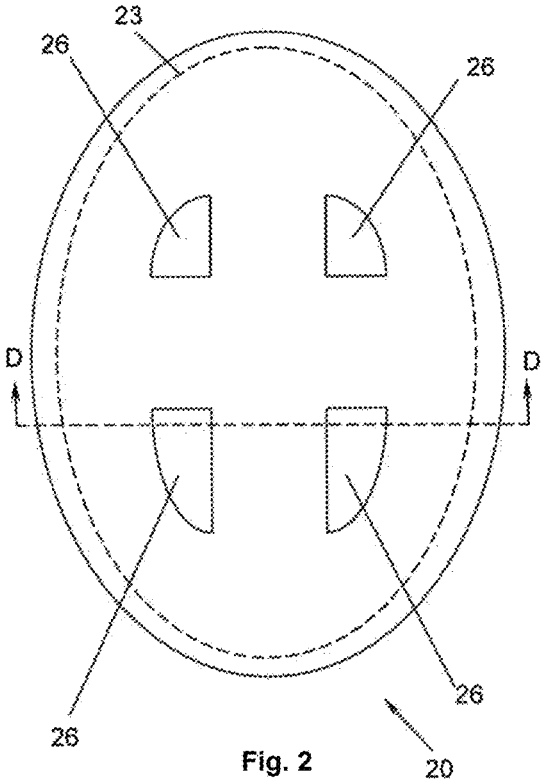
Figure 1A:
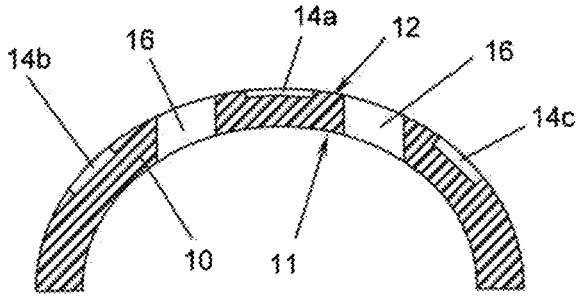
Figure 2A:
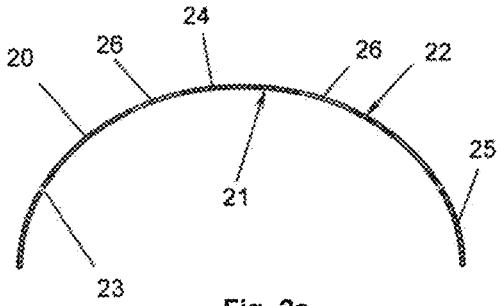
Figure 1B:
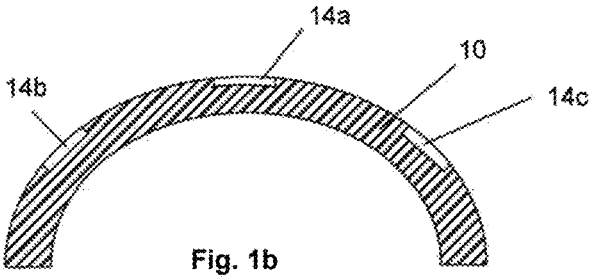
Figure 1C:
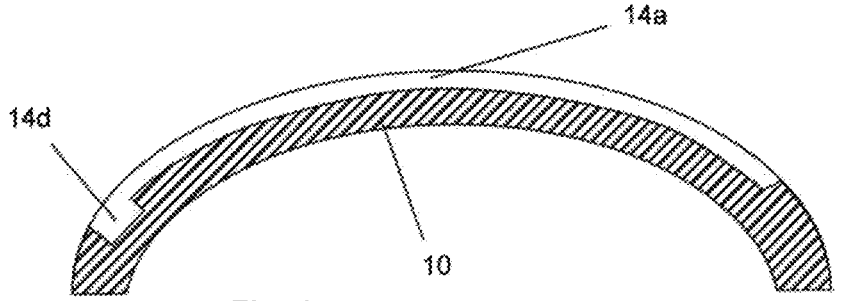
Figure 3:
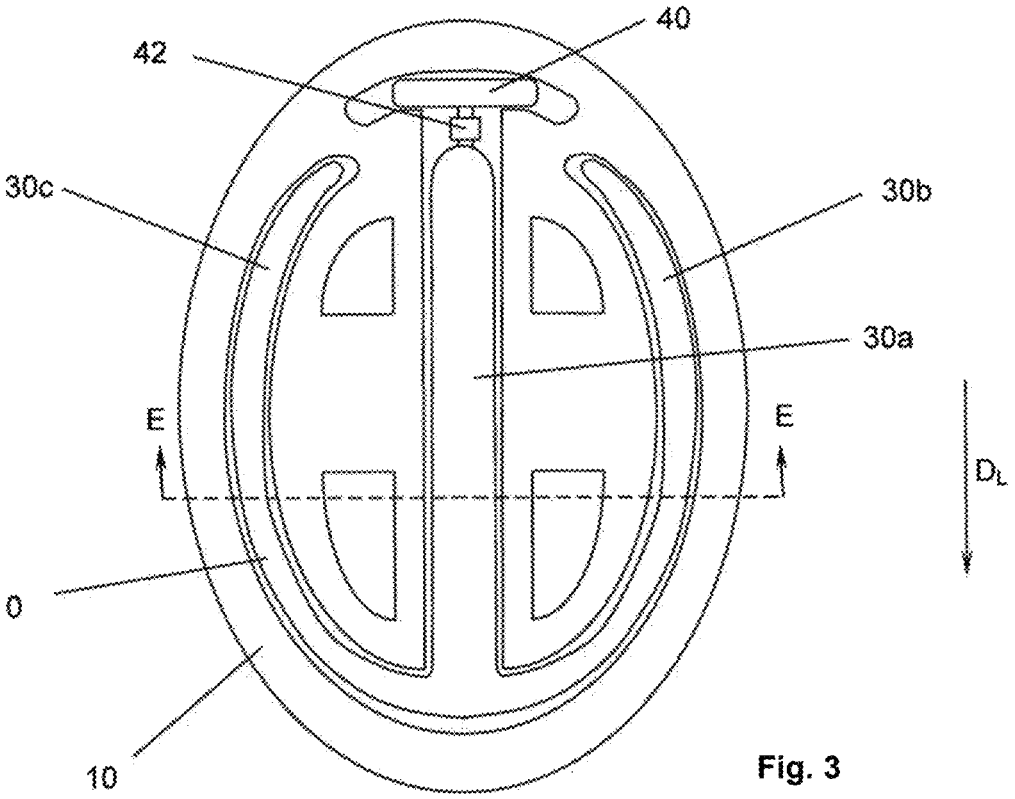
Figure 3A:
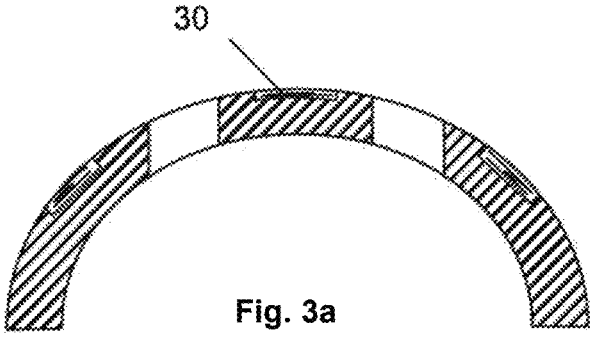
Figure 4:
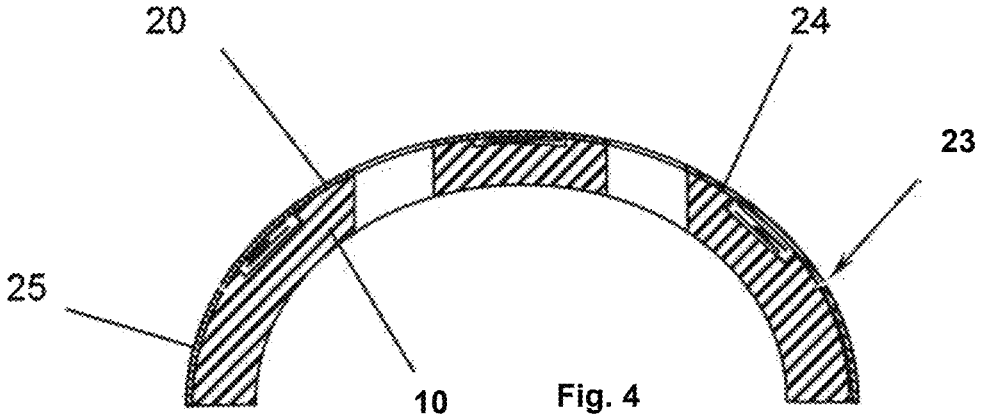
Figure 5:
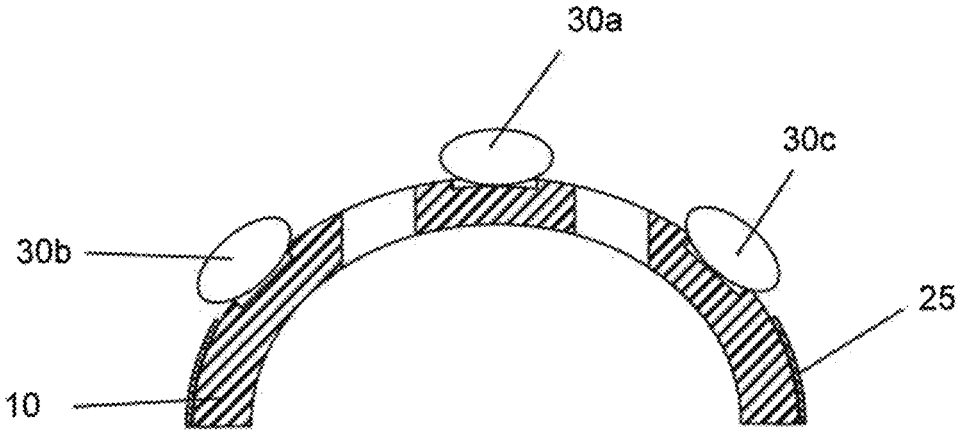
Figure 6:
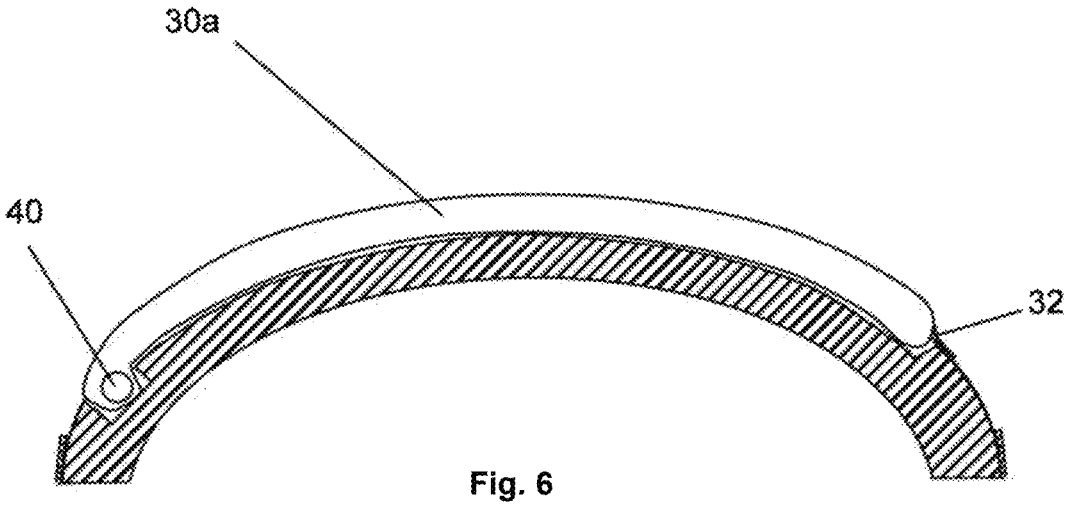
Figure 7:
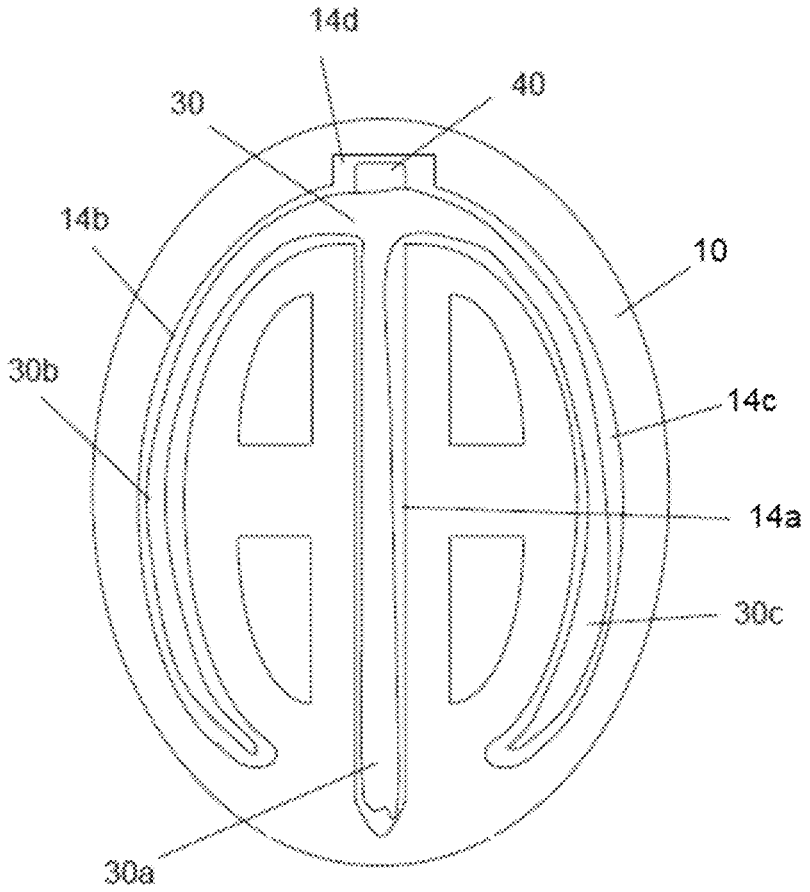
Figure 8:
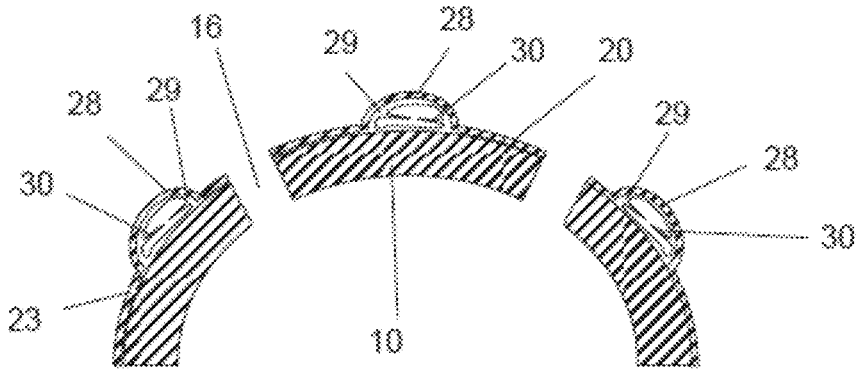
Figure 9A:
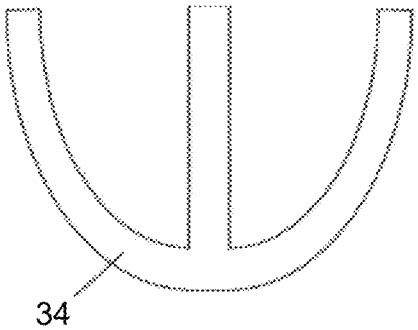
Figure 9B:
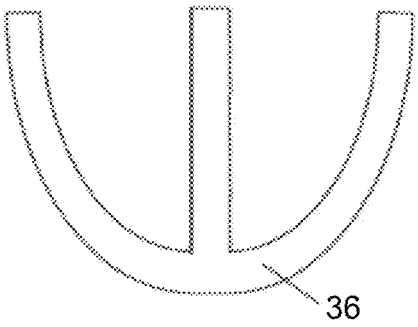
Figure 10:
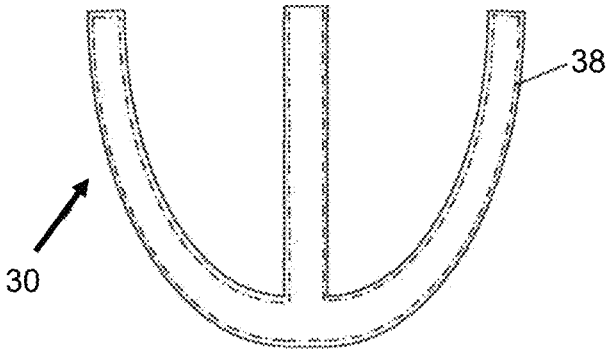
Figure 11:
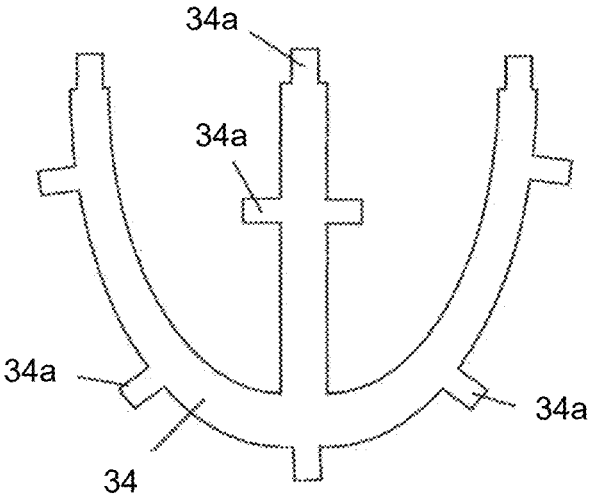

FIG. 1 is a schematic plan view onto a main body of a first embodiment of the inventive airbag-helmet, FIG. 1*a* is a sectional view taken along plane A-A in FIG. 1, FIG. 1*b* is a sectional view taken along plane B-B in FIG. 1, FIG. 1*c* is a sectional view taken along plane C-C in FIG. 1, FIG. 2 is a cover being adapted for being attached to the protective main body of FIG. 1 in a plan view according to FIG. 1, FIG. 2*a* is a sectional view taken along plane D-D in FIG. 2, FIG. 3 is the protective main body shown in FIG. 1 after attaching an airbag device to it, FIG. 3*a* is a sectional view taken along plane E-E in FIG. 3, FIG. 4 shows the items shown in FIG. 3*a* and the cover of FIG. 2*a* being attached to the protective main body, such that a bicycle helmet according to a first embodiment of the invention is formed, FIG. 5 shows the airbag-helmet of FIG. 4 after the airbag has been filled with gas such that it is in its deployed state, FIG. 6 is what is shown in FIG. 5 in a sectional representation according to FIG. 1*c*, FIG. 7 shows a second embodiment in a representation according to FIG. 3, FIG. 8 shows a third embodiment of the invention in a representation according to FIG. 4, FIGS. 9A and 9B each show a cutting that can be combined to form an airbag, FIG. 10 shows the airbag being sewn from the cuttings shown in FIG. 9, and FIG. 11 shows a variation to the first cutting of FIG. 9.

DETAILED DESCRIPTION OF PREFERRED EMBODIMENTS

FIGS. 1 to 1*c* show a protective main body. This protective main body 10 has the typical "half shell"-shape of a protective main body of a bicycle helmet. This protective main body 10 has a substantially concave inner surface 11 and a substantially convex outer surface 12. The minimum distance of the inner surface 11 and the outer surface 12 is typically at least five millimeters, but can be substantially larger. The protective main body 10 may be made of a lightweight foamed plastic material, like expanded polystyrene (EPS). As is known in the prior art, through openings 16 can extend through the protective main body.

According to the shown embodiment of the invention, the outer surface 12 of the protective main body 10 forms a groove 14. This groove 14 has a central section 14*a* extending in the longitudinal direction of the helmet along a substantial length of the helmet, two lateral sections 14*b*, 14*c* extending from the front end of the central section 14*a*, and an inflator section 14*d* extending from the rear end of central section 14*a*.

The central section 14*a* and the lateral sections 14*b*, 14*c* typically have a depth of several millimeters, wherein the depth is far less than the thickness of the protective main body 10. The depth of the inflator section 14*d* may exceeds the depth of the central section and the lateral sections.

FIGS. 2 and 2*a* show a cover 20 being adapted for being attached to the outer surface 12 of the protective main body 10. This cover 20 is substantially thinner than the protective main body 10 and typically consists of a non-foamed plastic material like polypropylene, polycarbonate or acrylonitrile butadiene styrene (ABS). This cover is of course also of a concave-convex shape and the inner surface 21 of the cover 20 conforms (except the grooves) to the outer surface of the protective main body 10. In the embodiment shown the cover 20 comprises a breaking line 23 which divides the cover 20 into an upper part 24 and an annular lower part 25. As for the protective main body 10, through openings 26 extend through the cover 20. These through openings 26 are basically congruent with the through openings 16 in the protective main body 10.

FIG. 3 shows the protective main body 10 shown in FIG. 1 and an airbag device attached to it. This airbag device comprises an airbag 30, an inflator 40 and an actuation mechanism 42. The airbag has three tubular protection sections 30*a* to 30*c* which extend essentially in a longitudinal direction DL from a rear end area of the protective main body 10 to a front end area of the protective main body 10. These three tubular protection sections 30*a* to 30*c* form a T whose junction is located at the front end area of the protective main body 10, such that the airbag 30 comprises a middle tubular protection section 30*a*, a right tubular protection section 30*b* and a left tubular protection section 30*c*. The airbag 30 is filled from the rear end of the middle tubular protection section 30*a*. The airbag 30 is folded into the central section 14*a* and the lateral sections 14*b*, 14*c* of the groove 14.

The inflator 40 is located in the inflator section of the groove 14 and is attached to the protective main body 10 as well as to the airbag 30 at least indirectly. This inflator 40 can be any type of known inflator, for example a pyrotechnic gas generator or an inflator comprising compressed gas.

The actuation mechanism 42 actuates the inflator and/or opens a fluid conduit between the inflator 40 and the airbag 30. In case that the inflator 40 is a pyrotechnic gas generator, the actuation mechanism 42 usually needs a battery or another electrical storage means such that it can ignite a pyrotechnic load of the inflator. In case that the inflator contains compressed gas, the actuation mechanism 42 might only need a valve. The latter case is schematically shown in FIG. 2 as an example, but is of course not limiting. Further, the actuation mechanism 42 comprises an acceleration sensor (also called inertia sensor) like it is known from automotive airbag devices. This acceleration sensor can work purely mechanical, especially with an inertia mass, or electronically, as is also known in the art.

FIG. 4 shows what is shown in FIG. 3*a* after the cover 20 has been attached to the protective main body 10; thus the complete bicycle helmet is shown. Usually an adhesive is used for attachment purposes. In order to allow an unhindered deployment of the airbag 13, the cover 20 is attached to the protective main body 10 only via the lower part 25 of the cover 20 (between the breaking line 23 and the edge). Straps that extend from the protective main body for securing the helmet to the user's head are not shown in this representation.

FIGS. 5 and 6 show the situation after deployment of the airbag 30. One sees, that the tubular protection sections 30*a* to 30*c* extend from the outer surface 12 of the protective main body 10 such that in the typical case that the airbag-helmet hits a essentially flat surface, this surface is first hit by the airbag 30. At the rear end, the airbag 30 is attached to the protective main body 10 via the inflator 40. Since one attachment point is usually not sufficient, at least one additional attachment is provided, here at the front region of the helmet. In the shown example, an attachment tether 32 is provided for this purpose. Of course it would also be possible to attach the airbag 30 directly to the protective main body 10. An example of an airbag having several attachment points will be described later.

The deployed tubular protection section may have a cross-sectional area of between 5 and 60 $cm^2$ and a length of between 30 and 45 cm.

FIG. 7 shows an alternative embodiment. The main difference to the embodiment just described is that the junction of the T of the airbag 30 is located at the rear end, such that all tubular protection sections 30*a* to 30*b* are filled from the rear. In this case at least each front end of a tubular protection section should be connected to the protective main body 10.

Instead of providing the protective main body 10 with grooves in order to create an accommodation for the airbag 30, it is also possible to provide at least one groove in the cover 20 for this purpose. An embodiment with such a cover-side groove 29 is shown in FIG. 8. Since the cover material is usually rather thin, the cover shows protruding regions 28 whose inner sides form the cover-side grooves 29.

It would also be possible that the accommodation for the airbag has at least one body-side groove and at least one cover-side groove opposite the body-side groove.

In all shown embodiments, of the airbag-helmet according to the invention, the total area of the used airbag material is small. This leads to a little need of storage space. Also, the space to be filled with gas is small, such that only a small and thus lightweight inflator is needed.

FIGS. 9A and 9B each show a cutting 34, 36 from which an airbag as schematically shown in FIG. 2 can be assembled such that each of those cuttings 34, 36 forms a layer of the airbag 30 (FIG. 10). The two cuttings are congruent and can consist of a woven plastic material. Each cutting may have an area between 500 and 1200 $cm^2$. The cuttings may consist of or comprise a basic material, for example a woven plastic material. This basic material is substantially inelastic and is also referred to as flexible, inelastic airbag material. The two cuttings 34, 36 can be assembled to the airbag 30 by applying a single connection for example a connecting seam 38 (FIG. 10). The airbag shown in FIG. 5 can of course be made in the same type of manufacturing process.

In contrast to a "classic" airbag being installed inside a vehicle, it is likely that the deployed airbag hits a rather rough surface. So, it can be preferred to provide a resistant coating or covering of the airbag, for example a protective textile layer which covers at least a part of the outer surface of the basic material, such that the airbag consists of—usually woven—basic material and the coating or covering layer. The coating itself might have elastic properties, but the airbag as a whole remains substantially inelastic.

As is shown in FIG. 11, at least one of the layers could comprise mounting ears 34*a*, such that the airbag can easily be attached to the basic body (for example by means of gluing) at a plurality of positions. This has the advantage that the deployed airbag is securely held in position in all conceivable accident scenarios. Another advantage is that such a plurality of mounting ears can help to shape the deployed tubular protection sections to have substantially oval cross-sections like shown in FIG. 5, instead of a substantially circular cross sections which they would have without additional measures. An oval cross-section has the advantage that the covered surface is enlarged without the need of increasing the volume of the airbag to be filled with gas.

While the above description constitutes the preferred embodiment of the present invention, it will be appreciated that the invention is susceptible to modification, variation and change without departing from the proper scope and fair meaning of the accompanying claims.

The invention claimed is:

1. An airbag-helmet comprising:

a protective main body having an inner surface facing towards a head of the user when the airbag-helmet is worn, and an outer surface facing away from the head of the user when the airbag-helmet is worn;

a cover attached to the outer surface of the main body;

an inflator; and a single airbag attached to the protective main body at least indirectly and being in fluid communication with the inflator, said single airbag comprising at least three tubular protection sections forming a T-shape, each of the at least three tubular protection sections extending along the outer surface of the protective main body when the single airbag is in an un-deployed state and when the single airbag is in a deployed state, wherein in the deployed state, the single airbag is filled with gas by the inflator and extends from the outer surface of the protective main body;

wherein at least one of the protective main body and the cover has a groove formed between the cover and the outer surface of the protective main body, the groove having a continuous bottommost surface located between the cover and the inner surface of the protective main body, wherein an entirety of the single airbag is located inside the groove between the protective main body and the cover when the single airbag is in the un-deployed state.

2. The airbag-helmet according to claim 1, wherein the at least three tubular protection sections are fillable by the inflator.

3. The airbag-helmet according to claim 1, wherein the at least three tubular protection sections extend substantially in a longitudinal direction of the airbag-helmet.

4. The airbag-helmet according to claim 1, wherein the protective main body is formed of a material selected from the group consisting of a rigid foamed material, a foamed plastic material, or an expanded polystyrene.

5. The airbag-helmet according to claim 1, wherein the protective main body has a minimum thickness between the inner surface and the outer surface of at least 5 mm.

6. The airbag-helmet according to claim 1, wherein the protective main body comprises through-openings extending from the outer surface to the inner surface.

7. The airbag-helmet according to claim 1, wherein the groove has a depth between 1 and 10 mm.

8. The airbag-helmet according to claim 1, further comprising an actuation mechanism configured for triggering the inflator or opening a passageway between the inflator and the single airbag, the actuation mechanism comprising an acceleration sensor.

9. The airbag-helmet according to claim 1, wherein the single airbag is attached to the protective main body by at least two attachment means, the at least two attachment means being remote from one another, wherein each of the at least three tubular protection sections is attached to the protective main body via a plurality of attachment points.

10. The airbag-helmet according to claim 1 wherein the single airbag comprises a flexible, inelastic airbag woven plastic material.

11. The airbag-helmet according to claim 10, wherein the single airbag comprises two layers of the flexible, inelastic airbag woven plastic material which are connected to one another.

12. The airbag-helmet according to claim 10, wherein the single airbag further comprises a coating covering at least a section of the flexible, inelastic airbag woven plastic material.

13. The airbag-helmet according to claim 1, wherein each of the at least three tubular protection sections has a cross-section between 5 and 60 $cm^2$ when fully deployed.

14. The airbag-helmet according to claim 1, wherein each of the at least three tubular protection sections has a length between 30 and 45 cm.

15. The airbag-helmet according to claim 1, wherein at least one of the at least three tubular protection sections extend at least 5 mm from the outer surface of the protective main body, when the single airbag is deployed.

16. The airbag-helmet according to claim 15, wherein at least one of the at least three tubular protection sections extend at least 10 mm from the outer surface of the protective main body, when the single airbag is in the deployed state.

* * * * *